US010300331B2

(12) United States Patent
Seltzer

(10) Patent No.: US 10,300,331 B2
(45) Date of Patent: May 28, 2019

(54) ENHANCED STABILITY FOREARM BUILDER DEVICE

(71) Applicant: Craig Seltzer, Glen Head, NY (US)

(72) Inventor: Craig Seltzer, Glen Head, NY (US)

( * ) Notice: Subject to any disclaimer, the term of this patent is extended or adjusted under 35 U.S.C. 154(b) by 67 days.

(21) Appl. No.: 15/701,361

(22) Filed: Sep. 11, 2017

(65) Prior Publication Data

US 2018/0071576 A1 Mar. 15, 2018

Related U.S. Application Data

(60) Provisional application No. 62/393,125, filed on Sep. 12, 2016.

(51) Int. Cl.

| | |
|---|---|
| ***A63B 21/00*** | (2006.01) |
| ***A63B 23/12*** | (2006.01) |
| ***A63B 23/035*** | (2006.01) |
| *A63B 21/008* | (2006.01) |

(52) U.S. Cl.

CPC ..... *A63B 23/1281* (2013.01); *A63B 21/154* (2013.01); *A63B 21/157* (2013.01); *A63B 21/4033* (2015.10); *A63B 23/03516* (2013.01); *A63B 21/008* (2013.01); *A63B 2225/09* (2013.01)

(58) Field of Classification Search

CPC ... A63B 21/008; A63B 21/154; A63B 21/157; A63B 21/4033; A63B 23/03516; A63B 23/1281; A63B 2225/09

See application file for complete search history.

(56) References Cited

U.S. PATENT DOCUMENTS

| | | | | |
|---|---|---|---|---|
| 6,099,437 | A * | 8/2000 | DeMers | A63B 23/14 482/46 |
| 6,312,359 | B1 * | 11/2001 | Brundle | A63B 21/0605 482/46 |
| 6,634,995 | B1 * | 10/2003 | Reed | A63B 21/153 482/132 |
| 7,753,827 | B1 | 7/2010 | Emick | |
| 2012/0245004 | A1 * | 9/2012 | Bremer | A63B 21/00185 482/129 |

* cited by examiner

*Primary Examiner* — Joshua Lee

(74) *Attorney, Agent, or Firm* — Integrity Patent Group, PLC; Charles E. Runyan

(57) ABSTRACT

An enhanced stability forearm builder is disclosed herein. The enhanced stability forearm builder includes a first handle bar and a second handle bar both having a first end and a second end, the first handle bar and second handle bar both being configured to be gripped by a hand of a user. A first end cap is removably attached to the first end of the first handle bar. The first handle bar and the second handle bar are attached by a connector. A ratchet system is located on the first handle bar and the second handle bar and is configured to allow rotation of the first handle bar and the second handle bar. A strap is coupled to the connector and configured to provide tension and lifting power. The enhanced stability forearm builder may be useful for building muscle on the forearm.

14 Claims, 4 Drawing Sheets

ENHANCED STABILITY FOREARM BUILDER DEVICE

CROSS-REFERENCE TO RELATED APPLICATION(S)

The present application is related to and claims priority to U.S. Provisional Patent Application No. 62/393,125 filed Sep. 12, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Technical Field

The present invention relates generally to the field of exercise equipment of existing art and more specifically relates to forearm muscle building exercise equipment.

Related Art

Interest in fitness and body building has substantially increased in the past decade. Fitness has been found to enhance a sense of wellbeing as well as to fight off many diseases. Doctors have long recommended a steady exercise program to keep healthy. Further, long term health studies have concluded that exercise is beneficial to a person's mental and physical wellbeing. Thus, a muscular physique has become a new standard of an overall healthy body.

A muscle set of particular daily importance and common focus are the muscles located in the forearms. These muscles are responsible for grip strength. Isometric grip strength is the ability to hold onto something, such as a barbell or a large container. Concentric grip strength is the ability to close the hand with a force against a resistance. Forearm extensors primary function is to extend the wrist. Common exercises such as bicep curls utilize forearm extensors as stabilizers, but do not isolate and exercise the forearm extensors specifically.

Forearm exercise machines are typically constructed from a piece of wood or short shaft with one side of a rope connected in the center of the shaft and the other connected to a weight. These devices are commonly called "wrist rollers" and work by forcing a repeated motion using the forearm muscles. A user will grip the shaft with one hand on either side of the connected rope with a weight at the end. The user proceeds to rotate the shaft, using the handle as a spindle to wrap the rope around. The forearm flexors and extensors are isolated and exercised by rolling the shaft in opposite directions. A problem with this homemade device is that when winding the rope, the weight begins to oscillate back and forth causing an instability in the exercise. Targeted forearm muscles cannot be completely isolated to exhaustion while other muscles in the body must be flexed for stability to support the swinging weight.

Currently, manufactured wrist rolling devices suffer from the same deficiency as the homemade option. For example, Emick, U.S. Pat. No. 7,753,827, discloses a forearm device similar to that of the homemade variation. Emick proposes a wrist roller device, much like the homemade version, with a bracket that rotatably attaches to the handle, where the bracket is supported by a string attached to an elevated structure such as a ceiling or a door frame. This device still suffers from the aforementioned problem of an oscillating weight. Further, this device has no means to effectively stop the weight from swinging, where with the homemade version the user may touch the weight to the ground to inhibit the swinging motion.

There exists a number of exercise machines that are each intended to work forearm of muscles. Users who are familiar with the art of bodybuilding agree that no substitution for wrist rolling currently exists to properly and effectively build forearm muscles. Those who are familiar with the prior art devices have been troubled with an uncentered weight impeding complete muscle isolation.

SUMMARY OF THE INVENTION

In view of the foregoing disadvantages inherent in the known forearm muscle building exercise equipment art, the present disclosure provides a novel enhanced stability forearm builder. The general purpose of the present disclosure, which will be described subsequently in greater detail, is to provide an enhanced stability forearm builder.

An enhanced stability forearm builder is disclosed herein. The enhanced stability device includes a first handle bar and a second handle bar joined by a connector. Both the first handle bar and the second handle bar are each defined by a first end and a second end and are configured to be gripped by the hand of the user. The first handle bar and second handle bar also include a first end cap and second end cap respectively, which are removable. A ratchet system is integrated into the first handle bar and the second handle bar for allowing rotation of the first handle bar and the second handle bar relative to the connector. A strap is attached to the connector for providing tension and lifting power between the enhanced stability device and a weight. The enhanced stability device is useful for building muscle in the forearm of the user.

According to another embodiment, a method for building muscle in the forearm of the user is also disclosed herein. The enhanced stability forearm builder includes, providing an stability device for building muscle in a forearm, as described above; attaching a weight and alternatively and exercise machine cable to the carabineer at the distal end of the strap; toggling the first knob on the first handle bar to allow a desirable rotation motion of the first handle bar; toggling the second knob on the second handle bar to allow a desirable rotational motion of the second handle bar; gripping the first handle bar and the second handle bar; and executing the exercise to build the forearm muscle by creating a rotational motion with the first and second handle bars.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an enhanced stability forearm builder, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to exercise equipment and more particularly to an enhanced stability forearm builder as used to build muscles in the forearm.

Generally, an enhanced stability device for building muscle in a forearm comprises a first handle bar having a first end and a second end, the first handle bar is configured to be gripped by a hand of a user. The enhanced stability device also includes a second handle bar having a first end and a second end, the second handle bar configured to be gripped by another hand of the user, wherein the first handle bar and the second handle bar are attached by a connector. A user will engage their isometric grip strength by gripping a handle bar with each hand. The user will then activate and exercise their forearm extensors by creating a rolling motion of the wrist against the resistance provided by the handle bars. A first end cap is removably attachable to the first end of the first handle bar. Similarly, the second end cap is removably attachable to the first end of the second handle bar. A ratchet system is located on the first handle bar and the second handle bar and is configured to allow rotation of the first handle bar and the second handle bar. A strap is coupled to the connector and configured to provide tension and lifting power, wherein the enhanced stability device is configured to build muscle in the forearm. The strap is approximately six inches wide to provide stability of the weight and inhibit any oscillatory motion of the weight at the end of the strap. The enhanced stability device further comprises a first guard being removably attached to the second end of the first handle bar. Similarly, a second guard is removably attached to the second end of the second handle bar. The connector is positioned between the first guard and the second guard. The enhanced stability device further comprises a first knob and a second knob to switch the allowed direction of the ratchet. A first knob, used to switch the allowed direction of the ratchet within the first handle bar is located on the first handle bar. Similarly, a second knob used to switch the allowed direction of the ratchet within the second handle bar is located on the second handle bar. Further, the strap attached to the connector includes a loop at the distal end, wherein the loop is reinforced with heavy stitching and configured to secure a carabiner. The carabiner is configured to attach to a cable machine or a similar device that will induce tension in the strap. Material of the first end cap and the second end cap is made of a material selected from the group consisting of rubber, plastic, and metal. The first handle bar and the second handle bar are made of a material selected from the group consisting of metal, plastic, and hard resin.

Figure 1:
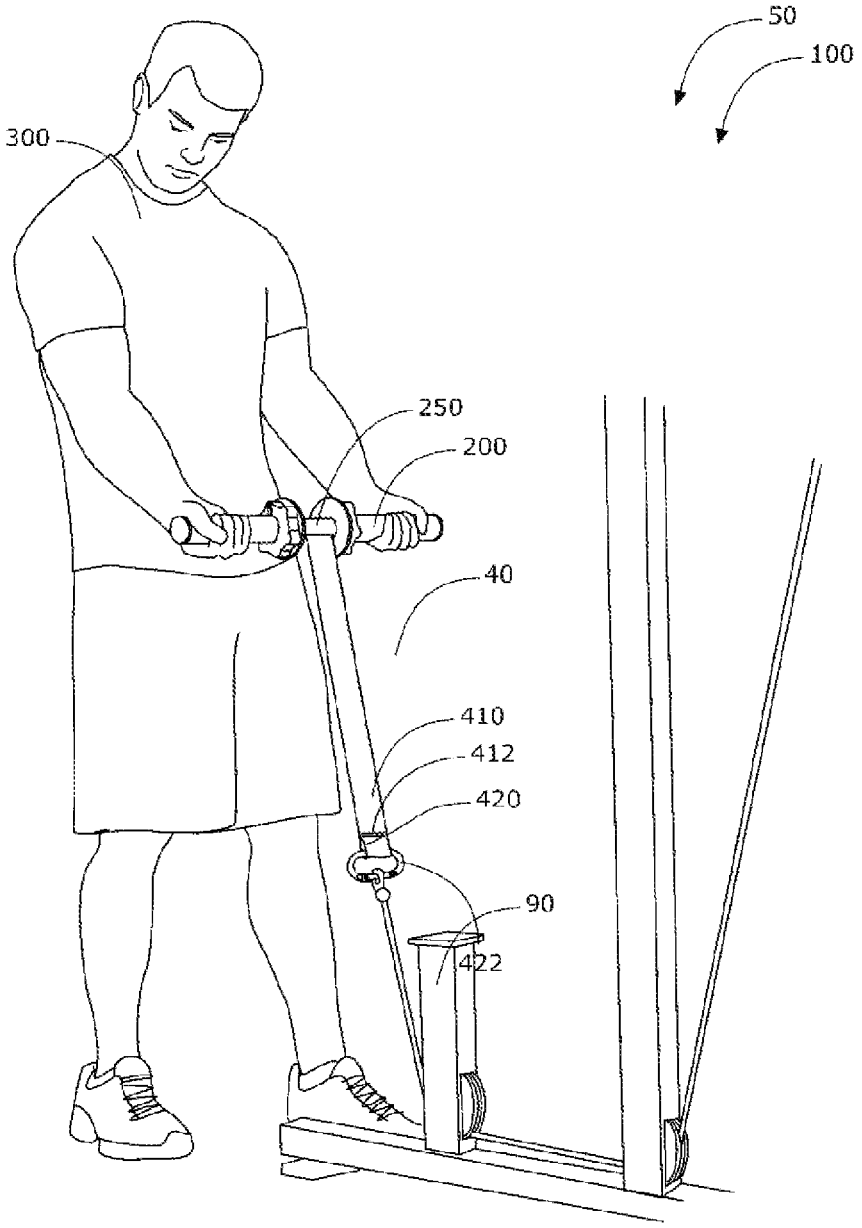
FIG. 1 is a perspective view of the enhanced stability forearm builder during an 'in-use' condition, according to an embodiment of the disclosure.
Figure 2:
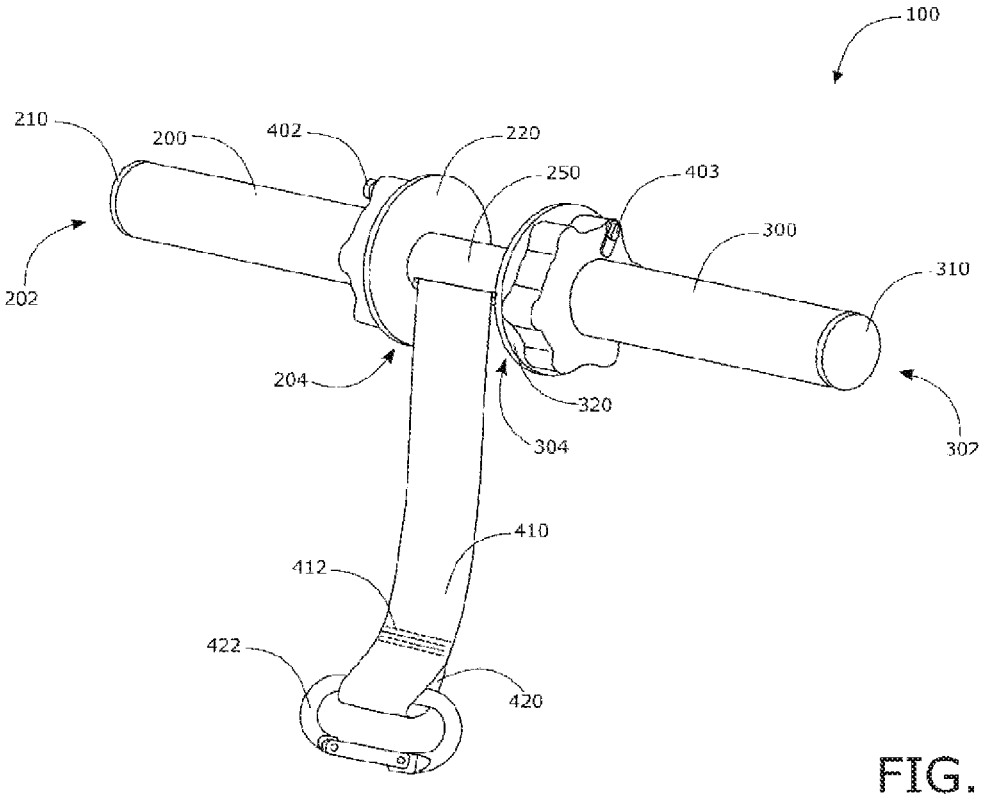
FIG. 2 is a perspective view of the enhanced stability forearm builder of FIG. 1 in isolation, according to an embodiment of the present disclosure.
Figure 3:
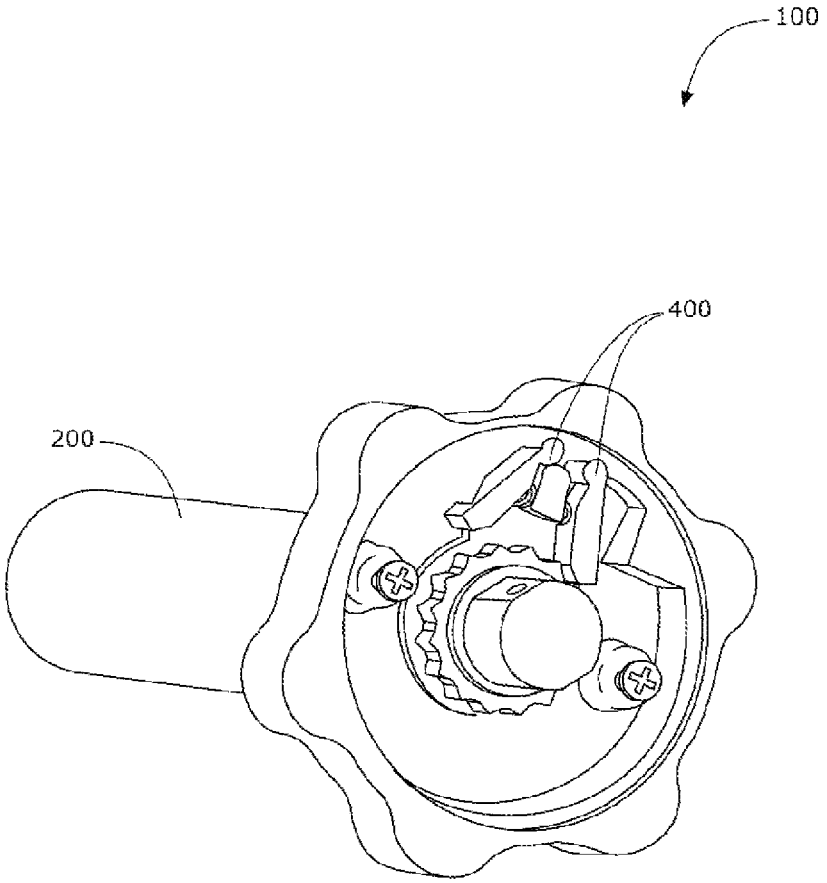
FIG. 3 is an exploded view showing details of the enhanced stability forearm builder of FIG. 1, according to an embodiment of the present disclosure.

Referring now more specifically to the drawings by numerals of reference, there is shown in FIGS. 1-3, various views of an enhanced stability device 100.

FIG. 1 shows an enhanced stability device during an 'in-use' condition 50, according to an embodiment of the present disclosure. Here, the enhanced stability device may be beneficial for use by a user 40 to build muscles in the forearms. As illustrated, the enhanced stability device 100 may include a first handle bar 200 and a second handle bar 300 for the user 40 to hold, a connector 250, a ratchet system (including internal ratchet 400 (FIG. 3) mechanisms), and a strap 410.

The first handle bar 200 and the second handle bar 300 are attached by the connector 250. The connector 250 is mechanically attached to the strap 410. At the distal end of the strap 410 (i.e., away from the connector 250), a load attachment an (e.g., loop 420) is fixed to the strap 410. For example, here load attachment is formed by a fold in the strap 410 that is fixed back on itself, for example, sewn together with heavy stitching 412. Other loops and fastening means are contemplated.

An internal ratchet 400 may be nested within or otherwise functionally coupled with each of the first handle bar 200 and the second handle bar 300, such that the internal ratchet 400 limits rotation of the first handle bar 200 and/or the second handle bar 300 to a single direction of engagement with respect to the connector 250. In other words, the internal ratchet 400 may provide for wrapping the strap 410 when wound in an "engaged" direction of rotation (e.g., "rolling" inward toward the user) and allowing the user to reset his/her grip in an opposite direction of rotation without releasing his/her grip of the first handle bar 200 and/or the second handle bar 300. It is understood that ratchet systems come in many forms and serve a similar function to toggle allowable rotation of a workpiece. Further embodiments of the internal ratchet 400 including the variety of forms of ratchet systems are contemplated.

According to one embodiment a quick release coupling may also be attached to the loop 420. For example, here, the enhanced stability device 100 may include a carabiner 422 that is attached to the loop. The carabiner 422 may be configured to attach to a cable machine 90 or other exercise load, which will provide weight to perform an exercise. For example the quick release coupling (carabiner 422) may be sized and dimensioned for standard or custom exercise equipment, and further may be made to a specification exceeding any contemplated load to be lifted and/or any limitations of individual component of the enhanced stability device 100, and may include additional factors of safety. For example, the quick release coupling (and any other individual component of the enhanced stability device 100) may have a minimum rating corresponding to a load of 50 lbs, 100 lbs, 250 lbs, or 1000 lbs.

FIG. 2 shows the enhanced stability device of FIG. 1, according to an embodiment of the present disclosure. As above, the enhanced stability device 100 may include a first handle bar 200 having a first end 202 and a second end 204 wherein a first endcap 210 is removably attached to the first end 202. The second end 204 may have an attached first knob 402 for toggling the allowed rotational direction of the first handle bar 200. The second end 204 may also have a first guard 220 that is removably connected to the first handle 200.

The enhanced stability device 100 of the present figure also includes a second handle bar 300 having a first end 302 and a second end 304 wherein a second endcap 310 is removably attached to the first end 302. The second end 304 has an attached second knob 403 for toggling the allowed rotational direction of the second handle bar 300. The second end 302 also has a second guard 320 that is removably connected to the second handle bar 300.

The first handle bar 200 and the second handle bar 300 are attached with a connector 250 piece, to which a strap 410 is attached. At the distal end of the strap 410 (i.e., away from the connector 250), a loop 420 is formed where the strap 410 is folded and heavy stitching 412 is applied. A carabiner 422 is attached to the loop for receiving weights or the like.

FIG. 3 is an exploded view showing details of the enhanced stability forearm builder of FIG. 1, according to an embodiment of the present disclosure. In particular, details of the ratchet system 400 illustrated. In this figure of the enhanced stability device 100, the internal ratchet 400 mechanism is shown attached to the first handle bar 200.

Figure 4:
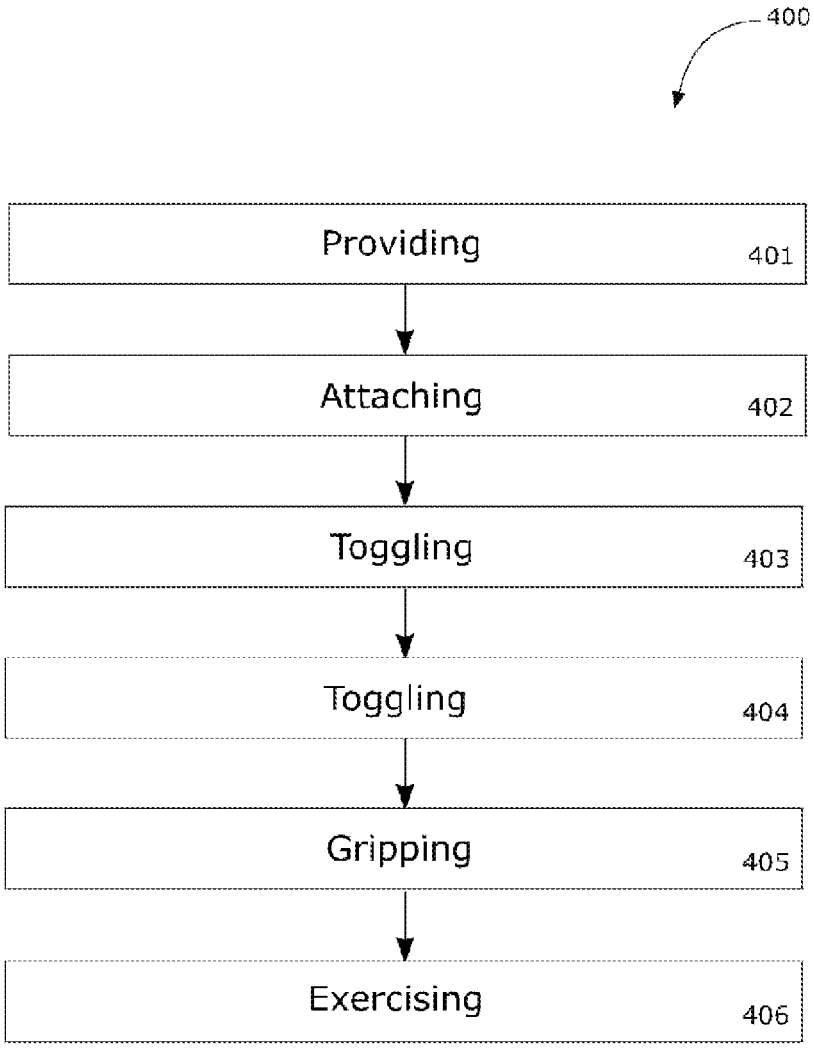
FIG. 4 is a flow diagram illustrating a method of building muscle in a forearm of a user, according to an embodiment of the present disclosure.

FIG. 4 is a flow diagram illustrating a method for building muscle in a forearm, according to an embodiment of the present disclosure. In particular, the method for building muscle in a forearm 400 may include one or more components or features of the enhanced stability device 100 as described above. As illustrated, the method for building muscle in a forearm 400 may include the steps of: step one 401, providing an enhanced stability device for building muscle in a forearm, said enhanced stability device including: a first handle bar having a first end and a second end, said first handle bar configured to be gripped by a hand of a user; a second handle bar having a first end and a second end, said second handle bar configured to be gripped by another hand of said user, wherein said first handle bar and said second handle bar are attached by a connector; a first end cap, said first end cap being removably attached to said first end of said first handle bar; a second end cap, said second end cap being removably attached to said first end of said second handle bar; a ratchet system, said ratchet system located on said first handle bar and said second handle bar and configured to allow rotation of said first handle bar and said second handle bar; a strap, said strap coupled to said connector and configured to provide tension and lifting power; and; step two 402, attaching a weight and alternatively an exercise machine cable to the carabineer at the distal end of the strap; step three 403, toggling the first knob on the first handle bar to allow desirable rotation direction of the first handle bar; step four 404, toggling the second knob on the second handle bar to allow desirable rotation direction of the second handle bar; step five 405, gripping said first handle bar and said second handle bar; step six 406, exercising the forearms by creating a rotational motion of said first handle bar and said second handle bar.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for building muscle in a forearm, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An enhanced stability device for building muscle in a forearm, said enhanced stability device comprising:

a first handle bar having a first end and a second end, said first handle bar configured to be gripped by a hand of a user;

a second handle bar having a first end and a second end, said second handle bar configured to be gripped by another hand of said user, wherein said first handle bar and said second handle bar are attached by a connector;

a first end cap, said first end cap being removably attached to said first end of said first handle bar;

a second end cap, said second end cap being removably attached to said first end of said second handle bar;

a ratchet system, said ratchet system located on said first handle bar and said second handle bar and configured to allow rotation of said first handle bar and said second handle bar;

a strap, said strap coupled to said connector and configured to provide tension and lifting power; and a plurality of knobs configured to switch the direction on ratcheting; and wherein said enhanced stability device is configured to build muscle in said forearm;

wherein said plurality of knobs include a first knob and a second knob;

wherein said first knob is located on said first handle bar; and wherein said second knob is located on said second handle bar.

2. The enhanced stability device of claim 1, further comprising a first guard, said first guard being removably attached to said second end of said first handle bar.

3. The enhanced stability device of claim 2, further comprising a second guard, said second guard being removably attached to said second end of said second handle bar.

4. The enhanced stability device of claim 3, wherein said connector is positioned between said first guard and said second guard.

5. The enhanced stability device of claim 1, wherein said strap is configured to hold a predetermined amount of weight.

6. The enhanced stability device of claim 1, wherein said strap is configured to attach to a cable machine.

7. The enhanced stability device of claim 1, wherein said strap includes a loop at a distal end of said strap.

8. The enhanced stability device of claim 7, wherein said loop is secured to said distal end of said strap by heavy stitching.

9. The enhanced stability device of claim 7, wherein said loop is coupled to a carabiner.

10. The enhanced stability device of claim 1, wherein said strap has a predetermined tensile strength that withstands a downward pull by said user.

11. The enhanced stability device of claim 1, wherein said first end cap and said second end cap is made of a material selected from the group consisting of rubber, plastic, and metal.

12. The enhanced stability device of claim 1, wherein said first handle bar and said second handle bar is made of a material selected from the group consisting of metal, plastic, and hard resin.

13. An enhanced stability device for building muscle in a forearm, said enhanced stability device comprising:

a first handle bar having a first end and a second end, said first handle bar configured to be gripped by a hand of a user;

a second handle bar having a first end and a second end, said second handle bar configured to be gripped by another hand of said user, wherein said first handle bar and said second handle bar are attached by a connector;

a first end cap, said first end cap being removably attached to said first end of said first handle bar;

a second end cap, said second end cap being removably attached to said first end of said second handle bar;

a ratchet system, said ratchet system located on said first handle bar and said second handle bar and configured to allow rotation of said first handle bar and said second handle bar;

a strap, said strap coupled to said connector and configured to provide tension and lifting power;

a first guard, said first guard being removably attached to said second end of said first handle bar;

a second guard, said second guard being removably attached to said second end of said second handle bar; and a plurality of knobs configured to switch the direction on ratcheting; and wherein said enhanced stability device is configured to build muscle in said forearm;

wherein said connector is positioned between said first guard and said second guard;

wherein said plurality of knobs include a first knob and a second knob;

wherein said first knob is located on said first handle bar;

wherein said second knob is located on said second handle bar;

wherein said strap is configured to hold a predetermined amount of weight;

wherein said strap is configured to attach to a cable machine;

wherein said strap includes a loop at a distal end of said strap;

wherein said loop is secured to said distal end of said strap by heavy stitching;

wherein said loop is coupled to a carabiner;

wherein said strap has a predetermined tensile strength that withstands a downward pull by said user.

14. A method for using an enhanced stability forearm builder, said method comprise the steps of:

providing an stability device for building muscle in a forearm, said enhanced stability device including a first handle bar having a first end and a second end, said first handle bar configured to be gripped by a hand of a user; a second handle bar having a first end and a second end, said second handle bar configured to be gripped by another hand of said user, wherein said first handle bar and said second handle bar are attached by a connector; a first end cap, said first end cap being removably attached to said first end of said first handle bar; a second end cap, said second end cap being removably attached to said first end of said second handle bar; a ratchet system, said ratchet system located on said first handle bar and said second handle bar and configured to allow rotation of said first handle bar and said second handle bar; a strap, said strap coupled to said connector and configured to provide tension and lifting power;

attaching a weight and alternatively an exercise machine cable to the carabineer at the distal end of the strap;

toggling a first knob on the first handle bar to allow desirable rotation direction of the first handle bar;

toggling a second knob on the second handle bar to allow desirable rotation direction of the second handle bar, gripping said first handle bar and said second handle bar; and exercising the forearms by creating a rotational motion of said first handle bar and said second handle bar.

* * * * *